US012560162B2

(12) United States Patent
Schellekens et al.

(10) Patent No.: US 12,560,162 B2
(45) Date of Patent: Feb. 24, 2026

(54) DRIVE ASSEMBLY COMPRISING A DRIVE WITH A MOVABLE STATOR, A PUMP AND A CONTROL VALVE, AND SYSTEM COMPRISING SUCH A DRIVE ASSEMBLY

(71) Applicant: HOLMATRO B.V., Raamsdonksveer (NL)

(72) Inventors: Marcus Petrus Augustinus Schellekens, Raamsdonksveer (NL); René Wilhelmus Johannes Van Eindhoven, Raamsdonksveer (NL); Adrianus Cornelis Maria Jacobs, Raamsdonksveer (NL); Titus Ludger Van Den Brink, Raamsdonksveer (NL)

(73) Assignee: HOLMATRO B.V., Raamsdonksveer (NL)

( * ) Notice: Subject to any disclaimer, the term of this patent is extended or adjusted under 35 U.S.C. 154(b) by 295 days.

(21) Appl. No.: 18/263,036

(22) PCT Filed: Jan. 25, 2022

(86) PCT No.: PCT/NL2022/050035
§ 371 (c)(1),
(2) Date: Jul. 26, 2023

(87) PCT Pub. No.: WO2022/164312
PCT Pub. Date: Aug. 4, 2022

(65) Prior Publication Data

US 2024/0309865 A1 Sep. 19, 2024

(30) Foreign Application Priority Data

Jan. 27, 2021 (NL) ..... 2027444

(51) Int. Cl.
*F04B 49/22* (2006.01)
*F04B 17/03* (2006.01)
*F04B 49/00* (2006.01)

(52) U.S. Cl.
CPC ..... *F04B 49/22* (2013.01); *F04B 17/03* (2013.01); *F04B 49/007* (2013.01)

(58) Field of Classification Search
CPC ..... F04B 49/225; F04B 49/22; F04B 17/03; F04B 49/007; H02K 2213/09
See application file for complete search history.

(56) References Cited

U.S. PATENT DOCUMENTS 6,517,891 B1 2/2003 Estelle et al.
7,249,458 B2 * 7/2007 Arbel ..... F15B 15/18 60/473

(Continued)

FOREIGN PATENT DOCUMENTS

DE 102004042208 A1 * 1/2007 ..... F04B 7/003
WO WO-2007010540 A2 * 1/2007 ..... F16D 31/06
WO 2020043843 A1 3/2020

OTHER PUBLICATIONS

International Search Report and Written Opinion of the ISA for PCT/NL2022/050035, mailed Apr. 4, 2022, 10 pages.

*Primary Examiner* — Nathan C Zollinger
(74) *Attorney, Agent, or Firm* — NIXON & VANDERHYE

(57) ABSTRACT

A drive assembly and system include a drive, controllable to exhibit a selected one of a plurality of drive modes that include driving the drive in one of a first driving direction and a second driving direction, the second driving direction being directed opposite relative to the first driving direction, a pump that is drivable by the drive and configured to produce a hydraulic flow to flow in a flow direction independent of the first or second driving direction of the (Continued)

selected drive mode, and a control valve that is configured to be set in a valve position associated with the selected drive mode and configured to thereby direct the hydraulic flow produced by the pump depending on the selected drive mode of the drive along a selected one or more of a plurality of flow paths that are arranged downstream of the pump.

18 Claims, 10 Drawing Sheets

(56) References Cited

U.S. PATENT DOCUMENTS

| | | | | |
|---|---|---|---|---|
| 9,638,179 | B2 * | 5/2017 | Sivaramakrishnan | F04B 7/00 |
| 10,421,447 | B2 * | 9/2019 | Leiber | B60T 8/328 |
| 11,273,547 | B2 * | 3/2022 | Schmollngruber | F15B 15/18 |
| 2013/0136623 | A1 | 5/2013 | Hwang et al. | |
| 2013/0205763 | A1 | 8/2013 | Caldwell et al. | |
| 2020/0256336 | A1 | 8/2020 | Terzo et al. | |

* cited by examiner

DRIVE ASSEMBLY COMPRISING A DRIVE WITH A MOVABLE STATOR, A PUMP AND A CONTROL VALVE, AND SYSTEM COMPRISING SUCH A DRIVE ASSEMBLY

CROSS-REFERENCE TO RELATED APPLICATIONS

This application is the U.S. national phase of International Application No. PCT/NL2022/050035 filed Jan. 25, 2022, which designated the U.S. and claims priority to NL 2027444 filed Jan. 27, 2021, the entire contents of each of which are hereby incorporated by reference.

BACKGROUND OF THE INVENTION

Field of Invention

The present invention relates to a drive assembly comprising a drive, a pump and a control valve. The invention is further related to a system comprising such a drive assembly.

Description of Related Art

Remote controlled prior art drive assemblies that comprise a drive, a pump and a control valve normally comprise a solenoid for setting a valve position of the control valve. In order to use such a drive assembly, a first control signal controls the drive that drives the pump, whereas a second control signal controls the valve position via the solenoid. Solenoids are often relatively large, heavy and complex, which is disadvantageous for some applications.

In particular for remotely controllable portable tools, there are often conflicting demands between safety and user comfort. Safe operation conditions often require the portable tool to be remotely operable, thereby allowing the user to remain at a safe distance during risky operations. After all, such portable tools are often used in unsafe conditions, for example for temporarily supporting or moving heavy loads, or for gaining access to shelters of criminals that may comprise booby traps. In addition to the desire of remote operation, such portable tools are preferably also compact and light weight in order to improve user comfort and versatility. It is therefore not desired to use large, heavy and costly solenoids in the design.

There is an ongoing need to improve the versatility of such drive assemblies, in particular improving the conflicting demands of safety and user comfort.

United States patent application US 2020/256336 A1, of which the embodiment shown in FIG. 9 thereof is considered to define the closest prior art for the present invention, discloses a valveless hydraulic system, wherein a motor is directly coupled to a pump. In this embodiment, a motor may be embodied as permanent magnet motor that is reversible. The pump system comprises two bi-directional ports which are each configured to output high pressure hydraulic work fluid to a work function such as a piston, depending upon the direction of the operation of the motor. In other words, the pump system may cause the high pressure hydraulic work fluid to flow in a first direction when the motor is driven in a first driving direction, and cause the high pressure hydraulic work fluid to flow in a second direction when the motor is driven in a second driving direction, that is opposite the first driving direction. This working function circuit is valveless due to the direct coupling between the motor and the pump, in line with the title "valveless hydraulic system" of US 2020/256336 A1.

In addition to the hydraulic work fluid associated with the work function, US 2020/256336 A1 proposes a further, separate circuit comprising hydraulic maintenance fluid intended for cooling and lubrication purposes. As it is important that this cooling and/or lubrication fluid always flows in the same direction, namely first past the controller, then past motor, and then through shaft coupling to provide lubrication, it is proposed to apply an additional check valve. In this way it is possible to guarantee that the hydraulic maintenance fluid intended for cooling and lubrication purposes always flows in the same direction, independently from the selected flow direction of the hydraulic work fluid.

United States patent U.S. Pat. No. 6,517,891 B1 and United States patent applications US 2013/136623 A1 and US 2013/205763 A1 are acknowledged as further prior art.

BRIEF SUMMARY OF THE INVENTION

An objective of the present invention is to provide a drive assembly, that is improved relative to the prior art and wherein at least one of the above stated problems is obviated or alleviated.

Said objective is achieved with the drive assembly according to the present invention, comprising:

- a drive, controllable to exhibit a selected one of a plurality of drive modes that comprise driving said drive in one of a first driving direction and a second driving direction, wherein the second driving direction is directed opposite relative to the first driving direction;
- a pump that is drivable by the drive and configured to produce an hydraulic flow;
- wherein the pump is configured to produce the hydraulic flow to flow in a flow direction that is independent of the first driving direction or the second driving direction of the selected drive mode; and
- the drive assembly further comprises a control valve that is configured to be set in a valve position associated with the selected drive mode and configured to thereby direct the hydraulic flow produced by the pump in dependence of the selected drive mode of the drive along a selected one or more of a plurality of flow paths that are arranged downstream of the pump.

The drive assembly according to the invention provides a simple, reliable and robust construction that allows a single control signal to control the drive assembly and set a desired one of a plurality of operation conditions. Moreover, the design may be compact and light weight. A single control signal suffices to control the drive and select one of the plurality of drive modes. The selected drive mode results in the control valve to be automatically set in an associated valve position, and thereby direct the hydraulic flow that is produced by the pump. Because this hydraulic flow is produced by the pump independent of the driving direction of the selected drive mode, the hydraulic flow will be present in all driving modes. The flow direction of the hydraulic flow produced by the pump is independent of the driving direction of the drive, and consequently the hydraulic flow always flows in the same flow direction relative to the pump. However, the specific driving mode at the same time controls the hydraulic flow path downstream of the pump via setting of the control valve. The drive assembly thus allows hydraulic flow to be directed via a control valve in a simple, robust and reliable construction. Because a solenoid may be absent, the drive assembly may be compact and light weight, making it especially suitable for remotely controlled portable tools.

According to the closest prior art US 2020/256336 A1, the pump system causes the high pressure hydraulic work fluid to flow in a first direction when the motor is driven in a first driving direction, and cause the high pressure hydraulic work fluid to flow in a second direction when the motor is driven in a second driving direction, that is opposite the first driving direction. It thus fails to disclose that the flow direction of the hydraulic flow produced by the pump is independent of the driving direction of the drive.

The check valve circuit disclosed in US 2020/256336 A1 belongs to a separate circuit comprising hydraulic maintenance fluid intended for cooling and lubrication purposes. It thus fails to disclose that the drive assembly further comprises a control valve that is configured to be set in a valve position associated with the selected drive mode and configured to thereby direct the hydraulic flow produced by the pump and flowing in the flow direction in dependence of the selected drive mode of the drive along a selected one or more of a plurality of flow paths that are arranged downstream of the pump.

The pump is typically a high pressure pump, preferably capable of providing a pressure of at least 500 bar. Such a high pressure allows the pump, and consequently the drive assembly that may be part of a portable tool, to be relatively compact and light weight. After all, using a high pressure, the pressure cylinders/plungers, may be relatively small for a specific pumping power. Small pressure cylinders, and the associated limited hydraulic fluid therein, that also results in a relatively small fluid reservoir, all contribute to a compact and lightweight design. Such a high pressure pump is preferably a plunger pump, which is typically capable of producing a pressure independent of a rotation direction of the pump.

According to a preferred embodiment, the drive comprises an electric motor that comprises a rotor and a stator, wherein the stator is configured to be set in one of a plurality of stator positions that are each associated with one of the plurality of drive modes. In conventional electric motors, the stator is a fixed component, as also reflected by the terminology "stator". It is now proposed to make the stator moveable, thereby allowing the torque of the drive to move the stator into one of a plurality of stator positions. These stator positions are each associated with one of the plurality of drive modes, thereby allowing the movement of the stator to control a control valve and thereby select one or more of a plurality of flow paths that are arranged downstream of the pump.

According to a further preferred embodiment, said stator is, relative to a pump housing of said pump, rotatable over a limited angular range between a first stator position and a second stator position. A limited angular range increases the reliability of the drive assembly by preventing electric wires connected to the stator to be torn apart or damaged by excessive repetitive movement.

According to an even further preferred embodiment, at least one of: the first stator position is a first extreme position of the stator when the drive is driven in the first driving direction; and the second stator position is a second extreme position of the stator when the drive is driven in the second driving direction. The stator positions being defined by the first and/or the second extreme position of the stator provides a reliable and reproducible setting of the stator positions. For example, the stator may be simply moved in the first driving direction until it reaches an extreme position that defines the first extreme position. A reproducible setting guarantees that the control valve may be accurately set, thereby reducing flow resistance.

According to an even further preferred embodiment, the stator is arranged on a carrier that is arranged concentric relative to a drive axis of the drive and rotatable over a predetermined angular range to allow the stator to be set in one of the plurality of stator positions. A carrier may be arranged on bearings, thereby reducing friction and allowing the stator positions to be set at a reduced torque of the drive.

According to an even further preferred embodiment, the drive assembly according to the invention preferably applies a mechanical link between the stator and the control valve to allow a configuration without a solenoid. However, even if the drive assembly would comprise a solenoid for specific use-cases, the present invention would provide the advantage that controlling of the control valve by the solenoid may be based on a control signal that is automatically derivable from the selected drive mode of the drive, thereby simplifying the control. After all, there would be no need anymore for the solenoids to be controlled via additional and independent control signals. For example, a four position control valve may be easily controlled by extracting control signals for the control valve from a control signal to control the drive, wherein each position is associated with a predetermined voltage.

According to an even further preferred embodiment, the carrier comprises a guide slot that is configured to guide the mechanical link when the carrier rotates relative to the pump housing and thereby adjust the valve position of the control valve. The guide slot allows the rotary movement of the stator and the carrier to be converted into a linear movement of the control valve.

According to an even further preferred embodiment, wherein the mechanical link is a lever arm that is pivotable around a pivot. A mechanical link is simple, robust and reliable, and may be manufactured at a high accuracy.

According to an even further preferred embodiment, wherein the plurality of drive modes comprises driving said drive at different driving speeds or different driving torques, and comprising a pretensioner that is configured to pretension the stator and thereby define a threshold force, wherein said pretensioner is configured to:

- maintain the stator in the first stator position when the rotor rotates below a predetermined rotation speed or driving torque associated with the threshold force; and
- allow the stator to rotate to the second stator position when the rotor rotates above the predetermined rotation speed or driving torque associated with the threshold force. This allows the control valve to have additional valve position in addition to the maximum of two valve positions that may be associated with the first extreme position and the second extreme position of the stator.

According to an even further preferred embodiment, the pretensioner is a spring. A spring provided a reliable pretensioner that allows the threshold force to be accurately set.

Preferred embodiments are the subject of the dependent claims.

BRIEF DESCRIPTION OF THE DRAWINGS

In the following description preferred embodiments of the present invention are further elucidated with reference to the drawing, in which.

DETAILED DESCRIPTION OF THE PREFERRED EMBODIMENTS

Figure 1A:
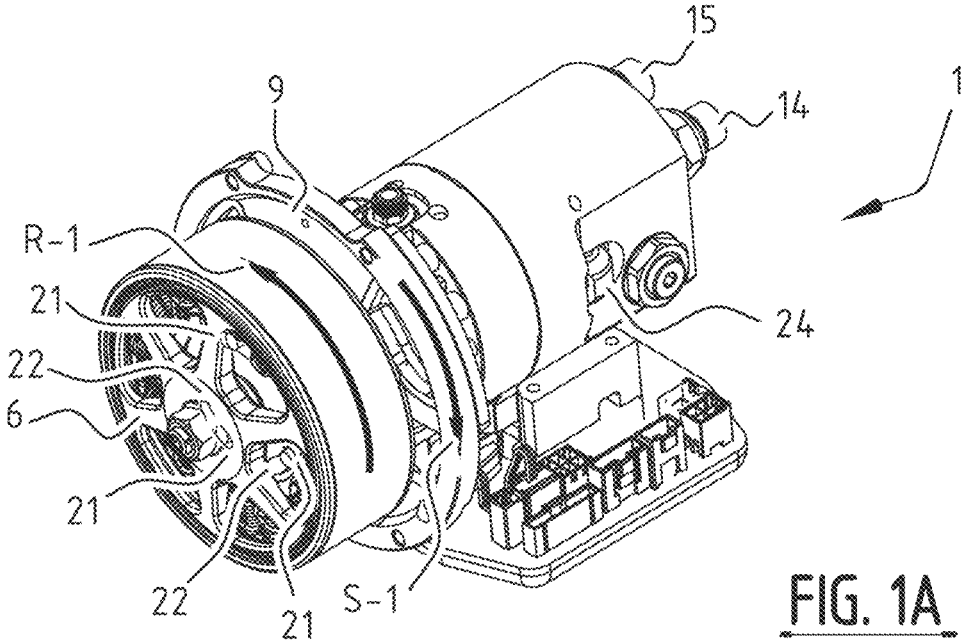
FIGS. 1A and 1B are a perspective view and a cross sectional view respectively of a drive assembly according to the invention in a first driving mode.

The drive assembly 1 comprises a drive 2 that is controllable to exhibit a selected one of a plurality of drive modes. These drive modes may comprise driving said drive 2 in one of a first driving direction (shown in FIGS. 1A and 1B) and a second driving direction (shown in FIGS. 2A and 2B), wherein the second driving direction is directed opposite relative to the first driving direction. The skilled person will however acknowledge that the drive mode is not necessarily limited to a driving direction, but may alternatively or additionally also comprise driving said drive 2 at different driving speeds or different driving torques.

In addition to the above mentioned drive 2, the drive assembly 1 further comprises a pump 3 that is drivable by the drive 2 and configured to produce an hydraulic flow F independent of a driving direction of the selected drive mode, and a control valve 4 that is configured to be set in a valve position associated with the selected drive mode and configured to thereby direct the hydraulic flow F along a selected one or more of a plurality of flow paths in dependence of the selected drive mode of the drive 2. The state shown in FIGS. 1A and 1B differs from the state shown in FIGS. 2A and 2B in that the driving direction of the drive 2 is opposite relative to each other, as indicated by the arrows in these Figures. These differing driving directions define the different drive modes of this specific embodiment.

The drive 2 comprises an electric motor 5 that comprises a rotor 6 and a stator 7 that is configured to be set in one of a plurality of stator positions N, $S_{1A}$, $S_{1B}$, $S_{2A}$ and $S_{2B}$ that are each associated with one of the plurality of drive modes. As shown in FIG. 3, N may denote a neutral stator position, $S_1$ and $S_2$ may denote stator positions in different directions of movement relative to the neutral stator position, e.g. clockwise and counterclockwise respectively, and an additional letter $S_{1A}$, $S_{1B}$, $S_{2A}$, $S_{2B}$ after the number may denote different stator positions in that specific direction. The state shown in FIGS. 1A and 1B and the state shown in FIGS. 2A and 2B both relate to different stator positions, for example positions $S_{1B}$ and $S_{2B}$ respectively, and the associated movement of the stator 7 is indicated with the arrows S. It is remarked that the drive 2, in addition to the electric motor 5, may additionally comprise an electronic controller 41 and possibly a (not shown) reduction or gearbox.

Stator 7 is, relative to a pump housing 8 of said pump 3, rotatable over a limited angular range between a first stator position $S_{1A}$, $S_{1B}$ and a second stator position $S_{2A}$, $S_{2B}$. If the drive 2 drives the rotor 6 in the first direction R-1 for driving the rotor 6 (shown in FIGS. 1A and 1B), the stator 7 will experience a force in the opposite direction, moving the stator 7 in direction S-1 until the stator 7 is maintained in its first stator position $S_{1A}$, $S_{1B}$. Vice versa, if the drive 2 drives the rotor 6 in the second direction R-2 for driving the rotor 6 (shown in FIGS. 2A and 2B), the stator 7 will move in direction S-2 towards the second stator position $S_{2A}$, $S_{2B}$.

Preferably, the first stator position is a first extreme position $S_{1B}$ of the stator 7 when the drive 2 is driven in the first driving direction. For example, a first abutment 21 may restrict the maximum angular displacement or the stator 7 and thereby define the first extreme position $S_{1B}$ of the stator 7. Likewise, the second stator position may be a second extreme position $S_{2B}$ of the stator 7 when the drive 2 is driven in the second driving direction. Again, a second abutment 22 may restrict the maximum angular displacement or the stator 7 and thereby define the second extreme position $S_{2B}$ of the stator 7.

In the shown embodiment, stator 7 is arranged on a carrier 9 that is arranged concentric relative to a drive axis 10 of the drive 2 and that is arranged rotatable over a predetermined angular range to allow the stator 7 to be set in one of the plurality of stator positions N, $S_{1A}$, $S_{1B}$, $S_{2A}$ and $S_{2B}$.

Figure 1B:
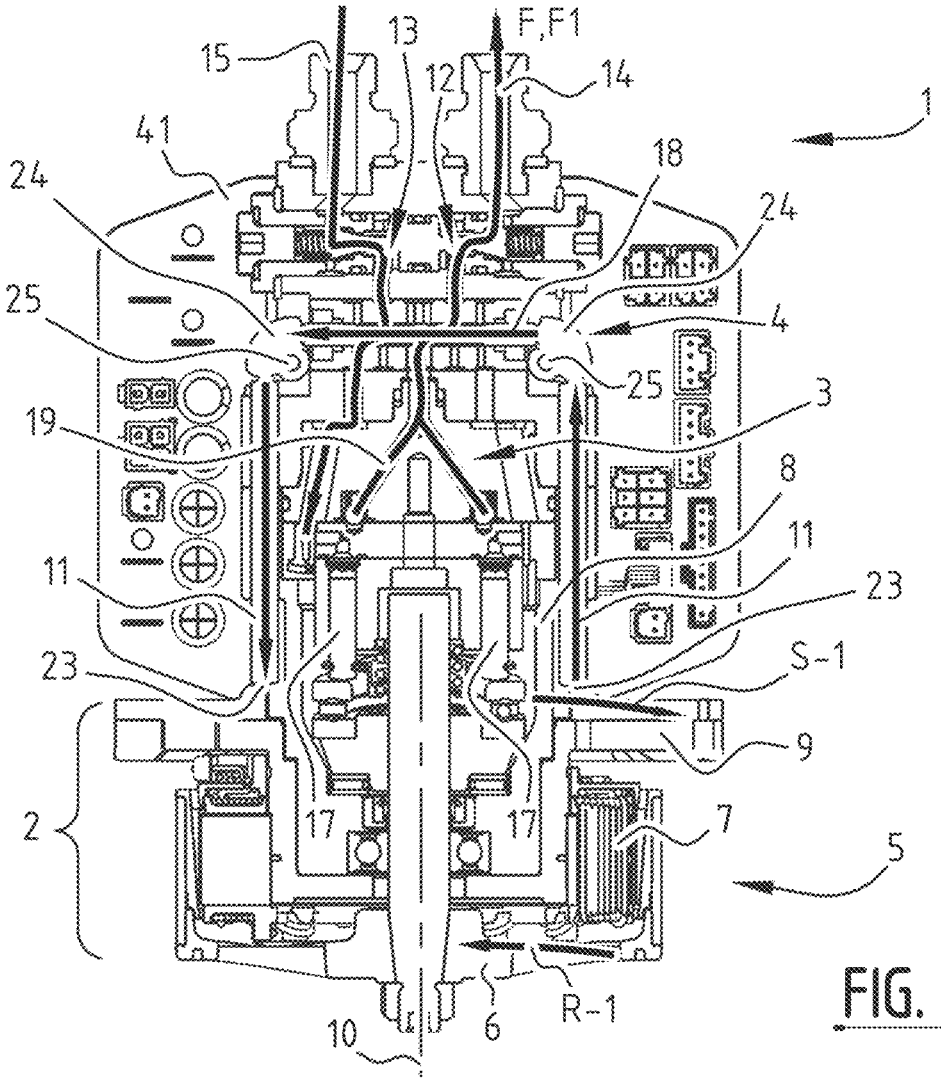
Figure 2A:
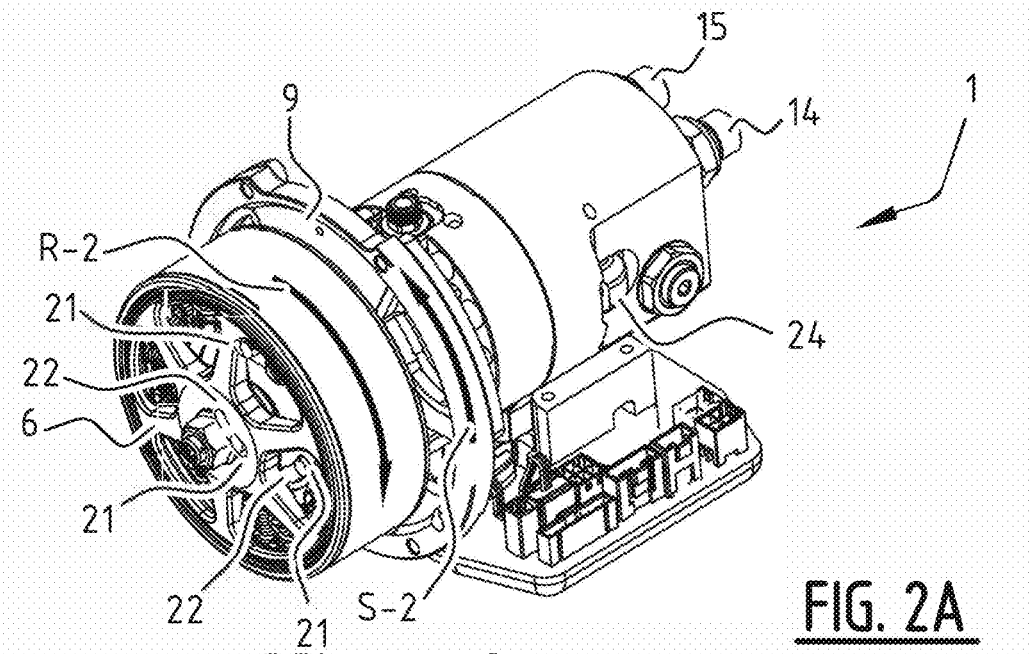
FIGS. 2A and 2B are a perspective view and a cross sectional view respectively of the drive assembly in a second driving mode.
Figure 2B:
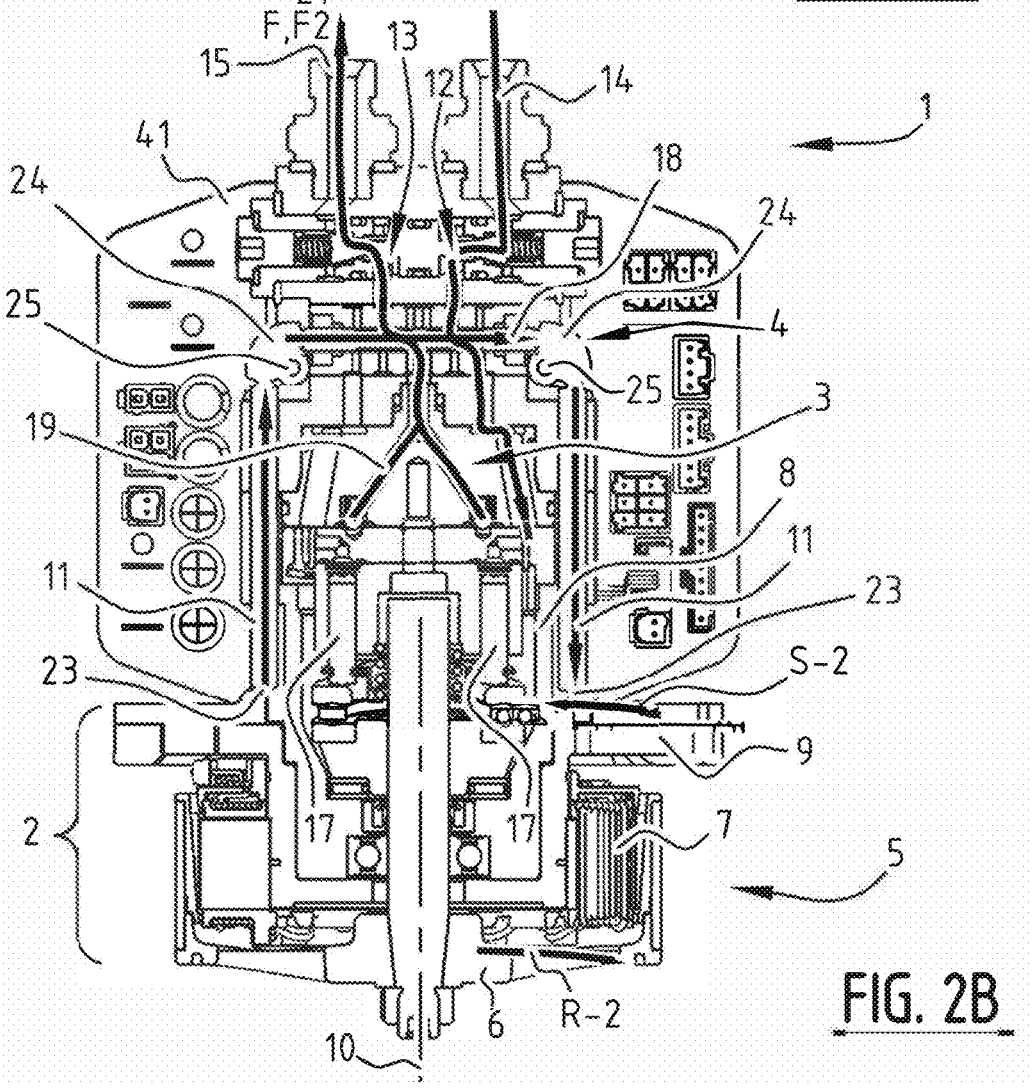
Figure 3:
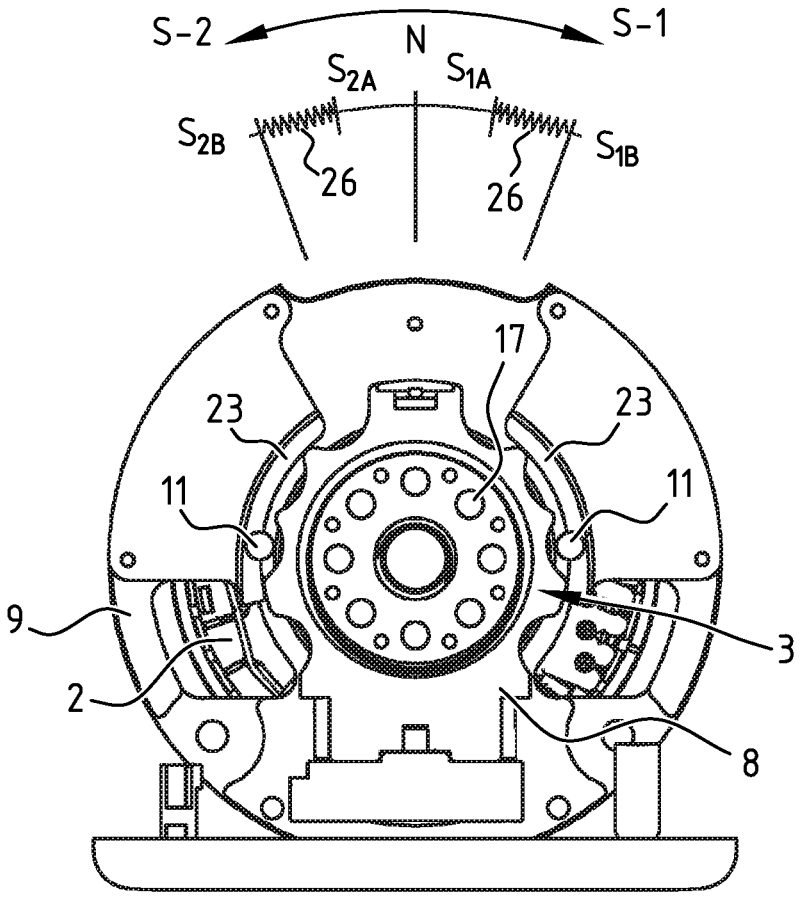
FIG. 3 is a frontal view of the drive assembly of FIGS. 1-2B, showing valve positions associated to some of the plurality of drive modes.

As can be best seen in the cross-sectional views of FIGS. 1B and 2B, the drive assembly 1 may further comprise a mechanical link 11 between the stator 7 or the carrier 9 and the control valve 4. For example, the carrier 9 may comprise a guide slot 23 that is configured to guide the mechanical link 11 when the carrier 9 rotates relative to the pump housing 8 and thereby adjust the valve position of the control valve 4. Mechanical link 11 may be embodied as a (not shown) lever arm that is pivotable around a pivot, or—as shown in the Figures—as a pin 11 that engages a lever 24 that pivots around a pivot 25 and thereby forces the valve body 18 in a desired valve position.

Drive assembly 1 may comprise at least a first valve opening 12 and a second valve opening 13, and wherein the control valve 4 is configured to exhibit:

- a first valve position (FIG. 1B) wherein the hydraulic flow F produced by the pump 3 is configured to flow in a first flow direction $F_1$, wherein the first valve opening 12 defines an outlet; and
- a second valve position (FIG. 2B) wherein the hydraulic flow F produced by the pump 3 is configured to flow in a second flow direction $F_2$ that is directed opposite the first flow direction $F_1$, wherein the second valve opening 13 defines the outlet.

Preferably, at least one of the second valve opening 13 defines an inlet in the first valve position (FIG. 1B), and the first valve opening 12 defines the inlet in the second valve position (FIG. 2B). In this way, the hydraulic flow F may exit the control valve 4 via one of the first valve opening 12 and the second valve opening 13, and—after passing through an hydraulic circuit 16, in particular of an hydraulic tool 20—re-enter the control valve 4 via the other of the first valve opening 12 and the second valve opening 13. Various embodiments of different hydraulic circuits 6 are shown in FIGS. 4,7, 9 and 10.

The drive assembly 1 and the hydraulic circuit may be integrated, i.e. the first and second valve openings 12, 13 may be in fluid connection with the hydraulic circuit 16 that may comprise conduits arranged inside a housing of the drive assembly 1. However, in order to increase the versatility of the drive assembly 1, which is in particular desired for portable tools, the drive assembly 1 may comprise a first connector 14 that is in fluid connection with the first valve opening 12, and a second connector 15 that is in fluid connection with the second valve opening 13. The first connector 14 and the second connector 15 may each be connected or connectable to the hydraulic circuit 16, for example of hydraulic tool 20.

In a preferred embodiment, said pump 3 comprises a plurality of pistons 17 that each produce hydraulic flow F, and the control valve 4 is configured to exhibit a plurality of valve positions configured to selectively control said hydraulic flow 4. For example, the selective control of the hydraulic flow F may comprise blocking an inlet of one or more of the plurality of pistons 17. Alternatively, the selective control of the hydraulic flow F may comprise diverting the hydraulic flow F produced by one or more of the plurality of pistons 17 back to a reservoir and thereby adjust the flow rate of the hydraulic flow f outputted by the drive assembly 1. In this way, additional pistons 17 may be activated if a higher flow rate (and lower pressure) are desired. Vice versa, the number of active pistons 17 may be reduced if a lower the flow rate and increased pressure is desired.

Based on FIGS. 1A, 1B and 2A, 2B, the invention will now be explained in more detail. Drive 2 may drive the rotor 6 in a selected one of the first direction R-1 and the second direction R-2. For both directions R-1, R-2, a hydraulic flow F will be produced. Thus, the hydraulic flow F is independent of the chosen driving direction R-1 or R-2 of rotor 6. However, the direction R-1 or R-2 in which the rotor 6 is driven by the drive 2 will cause the stator 7 to move to an associated stator position. In a simple embodiment, wherein the stator 7 comprises only two stator positions on opposite ends of an angular range, said stator positions may be denoted $S_{1B}$ and $S_{2B}$. In FIG. 1B, the stator 7 is set in the first stator position $S_{1B}$ by rotating carrier 9. This carrier 9 actuates, via a mechanical link 11, the valve position of the control valve 4. In FIG. 1B, the mechanical link 11 on the right side of the cross-section is pushed away from the carrier 9, and the mechanical link 11 on the left side of the cross-section moves towards the carrier 9. In this way, a valve body 18 may be displaced inside the control valve 4 to selectively open and shut-off specific one or more of a plurality of flow paths. In this way, the control valve 4 is set in a valve position associated with the chosen direction R-1, R-2 and configured to thereby direct the hydraulic flow F along a selected one or more of a plurality of flow paths in dependence of the selected direction R-1, R-2 in which the drive 2 drives the rotor 6. The exact position of the valve body 18, that is set via the stator position of stator 7, thus controls how the hydraulic flow F produced by the pistons 17 is allowed to flow inside the drive assembly 1. Starting from the pistons 17, said hydraulic flow F will flow via pressure channels 19 to the control valve 4, where the setting of valve body 18 determines if the hydraulic flow F is allowed to pass through the control valve 4, and if affirmative, whether the hydraulic flow F is allowed to follow a flow path to the first valve opening 12 and/or the second valve opening 13, before it enters the hydraulic circuit 16. In FIGS. 2A, 2B, the rotor 6 is driven in the second direction R-2, which is opposite the first direction R-1 of FIGS. 1A, 1B. Consequently, the stator 7 and its carrier 9 will rotate in the direction S-2. As indicated in FIG. 2B, the mechanical links 11 on the left and right side in the cross-sectional view move in opposite directions relative to FIG. 1B, thereby moving valve body 18 towards the right (in the figure) and setting the control valve 4 in a different valve position.

As mentioned above, the plurality of drive modes may also comprise driving said drive 2 at different driving speeds or different driving torques. In this case, the drive assembly 1 may comprise a pretensioner 26 that is configured to pretension the stator 7 and thereby define a threshold force, wherein said pretensioner 26 is configured to:

maintain the stator 7 in the first stator position $S_{1A}$, $S_{2A}$ when the rotor 6 rotates below a predetermined rotation speed or driving torque associated with the threshold force; and allow the stator 7 to rotate to the second stator position $S_{1B}$, $S_{2B}$ when the rotor 6 rotates above the predetermined rotation speed or driving torque associated with the threshold force. The pretensioner 26 may be a spring.

The driving torque causes a reaction torque between the stator 7 and, via the rotor 6, the pump housing 8 of the pump 3. If this torque increases, for example as a result of an increased rotation speed, above a pre-determined threshold force of a spring 26, this spring 26 may be compressed, thereby allowing the stator 7 to rotate to an associated stator position $S_{1A}$, $S_{1B}$, $S_{2A}$ and $S_2$B. In this way, the stator 7 may set control valve 4 in a valve position associated with the selected drive mode, i.e. the specific rotation speed/driving torque, and thereby direct the hydraulic flow F along a selected one or more of a plurality of flow paths in dependence of the rotation speed/driving torque of the drive 2.

Alternative embodiments may be configured to set the valve position in dependence of different thresholds for the rotation speed, or in dependence of a combination of the rotation direction and the rotation speed.

For specific embodiments, the drive assembly 1 may comprise one or more than one further control valve, configured to be set in a valve position associated with the selected drive mode and configured to thereby direct the hydraulic flow along a selected one or more of a plurality of flow paths in dependence of the selected drive mode of the drive.

Systems comprising a drive assembly 1 according to the invention may comprise an hydraulic tool 20 comprising the hydraulic circuit 16, wherein said hydraulic tool 20 is one of an hydraulic strut, a skidding tool, a cutter, a spreader, an hydraulic door opener (FIG. 8), a ram, a lifting cylinder 27 and the like.

In the description below, a variety of such practical uses of the drive assembly are explained using different embodiments. In order to prevent unnecessary repetition, the first embodiment is described in great detail, whereas the description of the further embodiments mainly discusses how the specific embodiment differs from the previously discussed embodiment(s). Similar reference numbers apply to the similar features.

Figure 4:
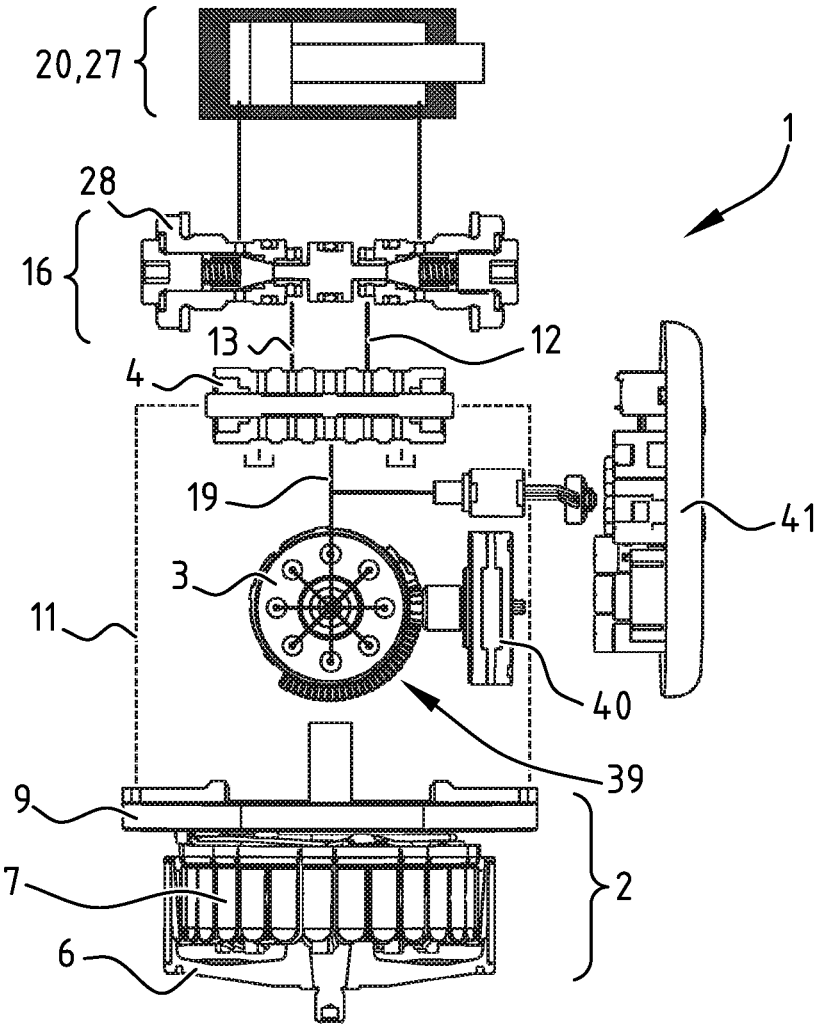
FIG. 4 is a schematic overview of a first embodiment according to the present invention showing a drive assembly of or for a double acting cylinder.

The first embodiment, that is shown in FIG. 4, shows a schematic overview of the drive assembly 1, fluidly connected to a lifting cylinder 20, 27 that is used for lifting and or lowering of heavy objects in a controlled manner. The drive assembly 1 can be directly mounted to the lifting cylinder 20, 27 or may be fluidly connected to connectors 14 and 15 via conduits, in particular via hoses. Lifting and lowering of heavy objects, for instance a de-railed railway vehicle, can be a dangerous and a very time consuming application. Often, a plurality of lifting cylinders 20, 27 are used to lift the heavy object in a balanced manner and to divide the total weight of the heavy object over the plurality of lifting cylinders 20, 27. In present day heavy lifting systems, often one centralised pump 3 is used to drive the lifting cylinders 20, 27. The pump that drives this plurality of lifting cylinders 20, 27 is therefore often relatively large, heavy and complex and is hard to place nearby the heavy object to be lifted and/or lowered. The present invention allows to have one drive assembly 1 per lifting cylinder 20. 27. Consequently, the drive assembly 1 can therefore be much smaller, more compact and less complex than the abovementioned centralised pump in present day heavy lifting systems. The plurality of drive assemblies 1 can, for instance, easily be carried by a user over railway tracks to be placed nearby the de-railed railway vehicle to be lifted and or lowered. However, to ensure safe lifting and lowering of the heavy object, the plurality of drive assemblies 1 are preferably simultaneously remotely controllable by a single remote controller unit. For example, the plurality of drive assemblies 1 may be wirelessly connected to the single controller unit, for example via a wireless connection. The wireless connection may be made by a wireless receiver that is embedded into electronic controller 41, wherein electronic controller 41 is also configured to set a selected one of the plurality of drive modes of drive 2. The wireless protocol may be Bluetooth or WiFi, but is not limited thereto.

To enable remotely controlled lifting and lowering of the heavy object, the lifting cylinder 20, 27 may be a double acting type of cylinder and the drive assembly 1 may be configured to drive the lifting cylinder 20, 27 to extend when the drive 2 is driven in the first driving direction; and to drive the lifting cylinder 20, 27 to retract when the drive 2 is driven in the second driving direction. The hydraulic circuit 16 may comprise a load holding valve 28 that is configured to hold the load if the drive assembly 1 is not driven or in the event of a sudden loss of pressure, e.g. due to an unexpected hose rupture. The hydraulic circuit 16 may further comprise a (not shown) pressure compensated flow control valve to enable smooth lowering of the heavy load.

Figure 5:
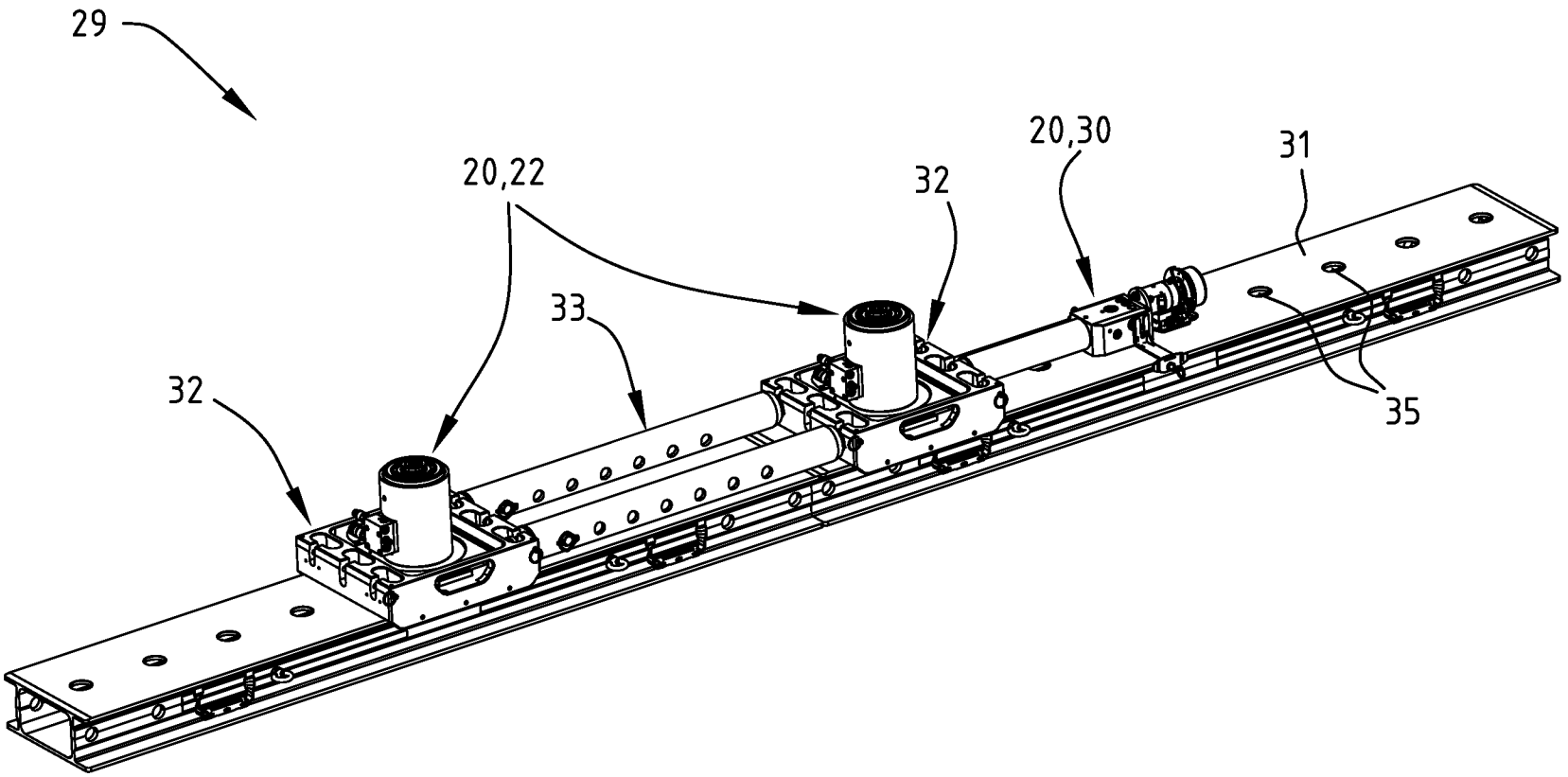
FIG. 5 is a perspective view of a second embodiment according to the present invention showing a rerailing system.

The second embodiment, that is shown in FIG. 5, shows a perspective view of a rerailing system 29. The rerailing system 29 comprises at least one lifting cylinder 20, 27 that is configured to lift a de-railed railway vehicle as described in the first embodiment. It further comprises a beam sledge 32, configured to carry the load of the to be lifted, de-railed railway vehicle via the lifting cylinders 20, 27, and further configured to slide over a beam 31 in a longitudinal direction of the beam 31. The beam 31 is configured to be placed over the railway track of the de-railed railway vehicle and comprises locking holes 35 configured to accept a locking pin 34 (FIG. 6) of a traverse cylinder 20, 30. The traverse cylinder 20, 30 is configured to push and/or pull the at least one beam sledge 32 over the beam 31 in a translating direction to re-align the de-railed railway vehicle to its railway track. If the rerailing system 29 comprises more than one beam sledge 32, it may further comprise at least one spacer 33 between adjacent beam sledges 32.

Figure 6:
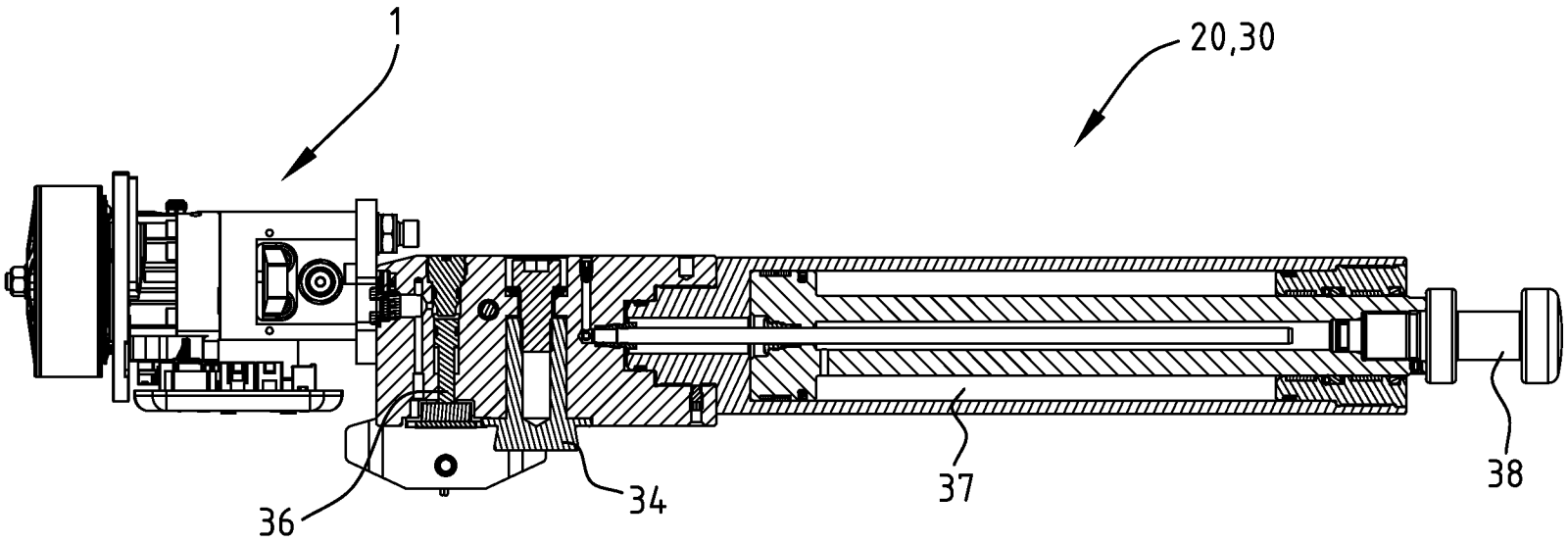
FIG. 6 is a cross-sectional view of the second embodiment according to the present invention showing a traverse module of the rerailing system.

FIG. 6 shows a cross-sectional view of the traverse cylinder 20/30 of the rerailing system 29 of the second embodiment. The traverse cylinder 20/30 comprises a first cylinder 36 of a single acting, spring return cylinder type, a locking pin 34 and a second cylinder 37 of a double acting cylinder type, that is rigidly connected to a push pull head 38. The locking pin 34 is configured to lock into locking holes 35 of the beam 31 when the first cylinder 36 is in a retracted state, and to be pushed out of the locking holes 35 of the beam 31 when the first cylinder 36 is in a extended state. The push pull head 38 is configured to be mounted into the beam sledge 32, and to exert a pushing or pulling force, derived from the second cylinder 37, onto the beam sledge 32 to create a translating movement of the at least one beam sledge 32 to re-align the de-railed railway vehicle to its railway track.

Figure 7:
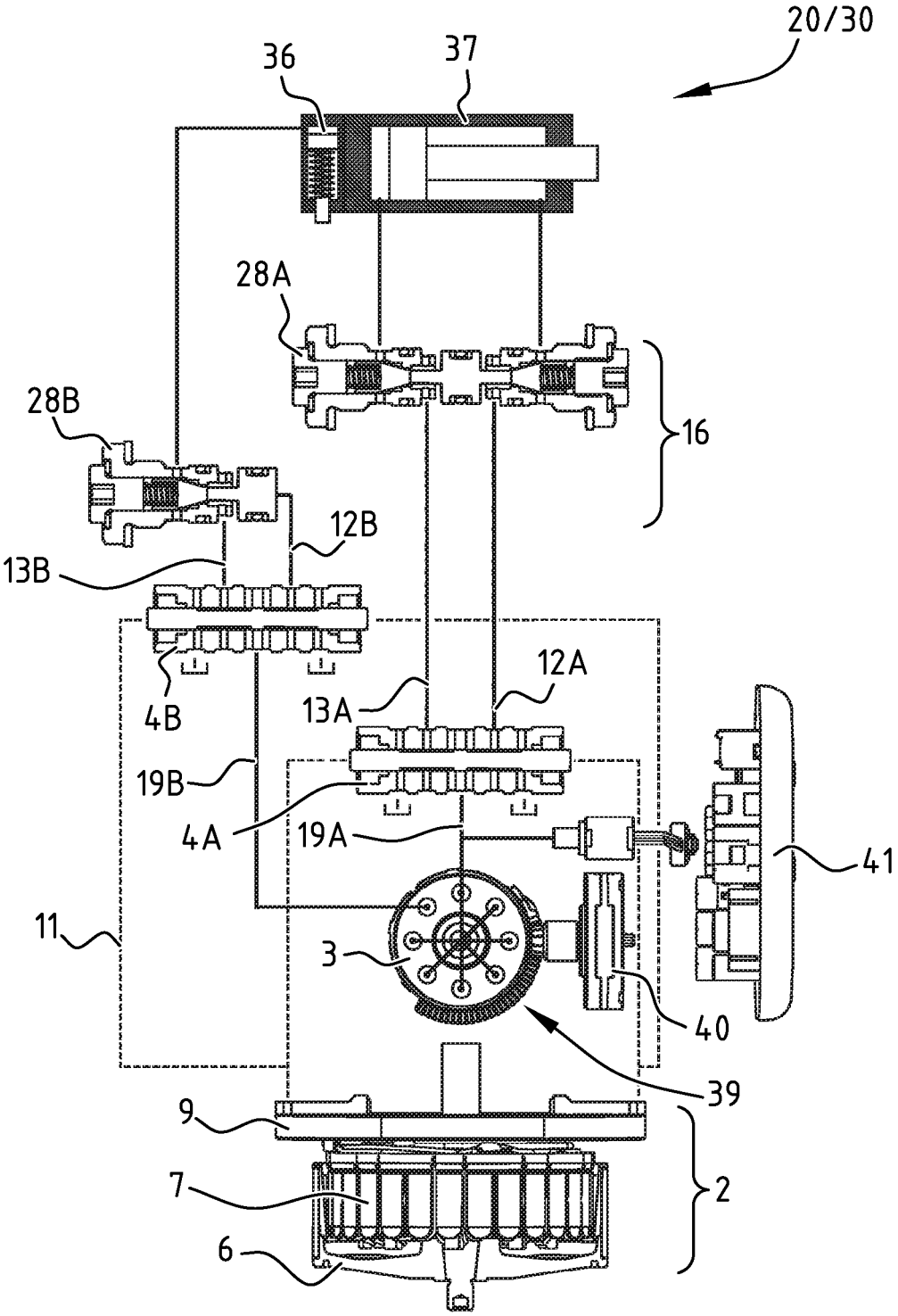
FIG. 7 is a schematic overview of the second embodiment according to the present invention showing a drive assembly of the traverse module of the rerailing system.

FIG. 7 shows a schematic overview of traverse cylinder 20, 30 of the rerailing system 29 according to the second embodiment. In contrast to the first embodiment, the traverse cylinder 20, 30 comprises: a first pressure channel 19A and a separate second pressure channel 19B, both outputted from different sets of the pluralities of pistons 17 from pump 3; a first control valve 4A connected to the first pressure channel 19A and having a first valve opening 12A and a second valve opening 13A; and a second control valve 4B connected to the second pressure channel 19B and having a first valve opening 12B and a second valve opening 13B. The first control valve 4A is configured to extend or retract the second cylinder 37 in correspondence with the selected one of the plurality of drive modes of drive 2. The second control valve 4B is configured to extend or retract the first cylinder 36 in correspondence with the selected one of the plurality of drive modes of drive 2.

Traverse cylinder 20, 30 of the rerailing system 29 may further comprise a ring shaped element 39 and a motor 40, which are both described in the international patent application WO 2020 043843 A1 of Applicant, which is herein incorporated by reference, and an electronic controller 41. The ring shaped element 39 comprises a plurality of lips configured to block or open one or more of the suction ports of the plurality of pistons 17. The motor 40 is configured to rotate the ring shaped element 39 around pump 3, thereby selectively blocking or opening certain ones of the plurality of pistons 17. The electronic controller 41 may be configured to set a selected one of the plurality of drive modes of drive 2, to drive the motor 40, and to receive a (wireless) signal from a remote controller unit.

Selective blocking of the suction ports of the pistons 17 that are in correspondence with the second pressure channel 19B eliminates the hydraulic flow F in the second pressure channel 19B, thereby eliminating any movement of the first cylinder 36 regardless of the position of the second control valve 4B. However, if simultaneously, the suction ports of the pistons 17 that are in correspondence with the first pressure channel 19A are opened, the second cylinder 37 will be driven by drive 2 in the direction associated with the selected drive mode.

On the contrary, blocking the suction ports of the pistons 17 that are in correspondence with the first pressure channel 19A eliminates the hydraulic flow F in the first pressure channel 19A, thereby eliminating any movement of second cylinder 37 regardless of the position of the first control valve 4A. However, if simultaneously, the suction ports of the pistons 17 that are in correspondence with the second pressure channel 19B are opened, the first cylinder 36 will be driven by the drive 2 in the direction associated with the selected drive mode. As both the drive modes of drive 2 and the drive mode of the motor 40 are set by the electronic controller 41, which is in turn controllable via a (wireless) connection by a remote control unit, it is now possible to remotely, individually control both the first cylinder 36 and the second cylinder 37 in an extending and retracting direction.

Since the first embodiment and the second embodiment can both be used in, for instance, rerailing applications, one remote control unit can control all drive assemblies 1 used in a combined application of the first and the second embodiment.

Figure 8:
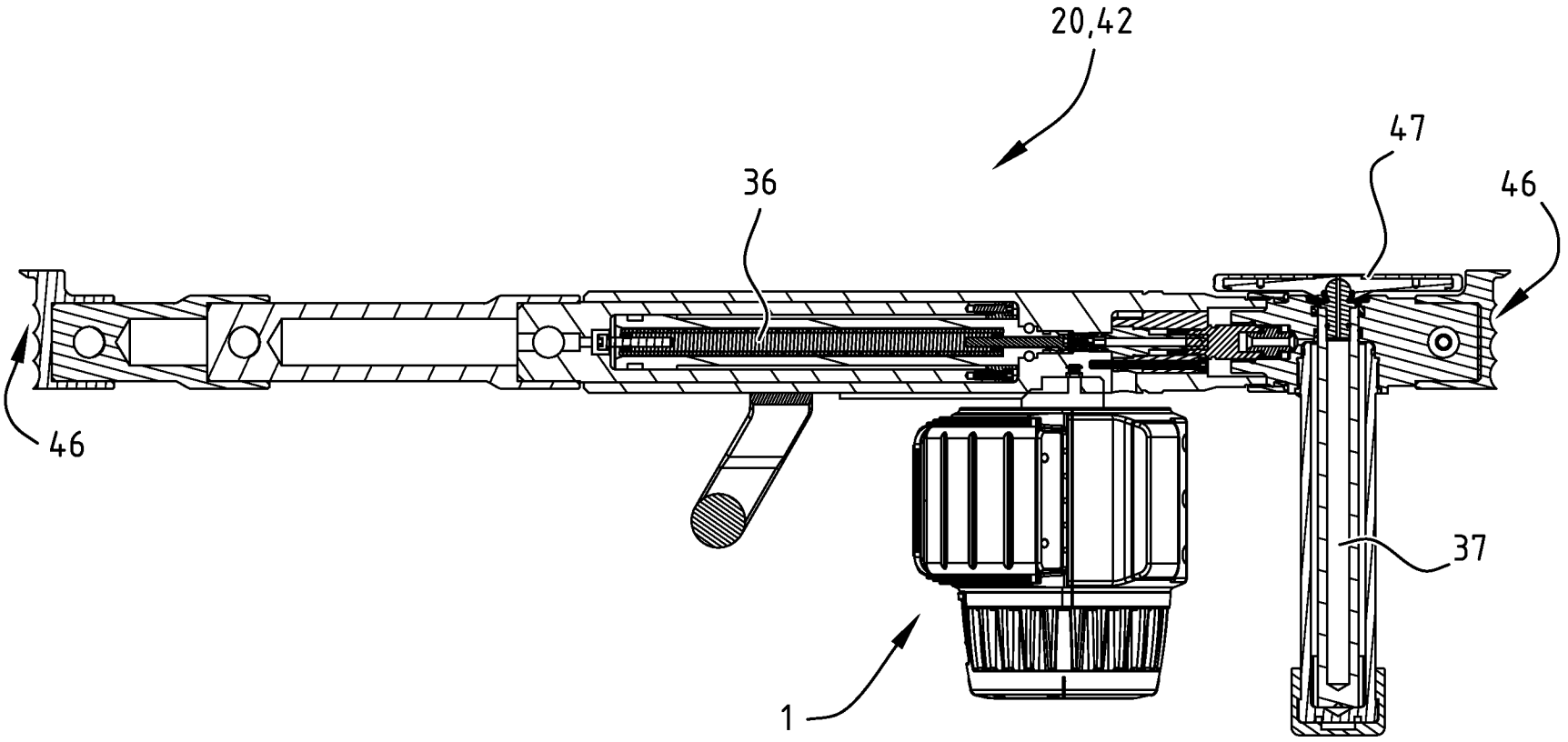
FIG. 8 is a cross-sectional view of a third embodiment according to the present invention showing a forcible entry tool.

The third embodiment, that is shown in FIG. 8, shows a cross-sectional view of a forcible entry tool 20, 42. The forcible entry tool 20, 42 comprises: a first cylinder 36 of a single acting, spring return cylinder type; two grip heads 46 located on the outer ends of the first cylinder; a second cylinder of a single acting, spring return cylinder type; and a push plate 47 located on the piston side of the second cylinder. Such a forcible entry tool 20, 42 is often used by law enforcement and military teams for gaining access to shelters of criminals that may comprise booby traps or where firearms could be used by the criminals when their shelter is being forcibly entered. As a logical result, the operator needs to be able to control the forcible entry tool 20, 42 from a safe distance. However, initial placement of the forcible entry tool 20, 42 requires the operator to first clamp the forcible entry tool 20, 42 into a doorframe by hydraulically extending the first cylinder 36 and letting the grip heads 46 engage, i.e. bite into, the doorframe. This step requires maneuverability of the operator, which could be enhanced by the forcible entry tool 20, 42 being as compact and lightweight as possible. After initial placement, the law enforcement and/or military teams move to a safe distance from where the secondary cylinder 37 is controlled in an extending direction, pushing the door inwards, and gaining access to the criminal shelter. After the door is opened, pressure of the first cylinder 36 is released thereby releasing the clamping force and causing the forcible entry tool 20, 42 to drop on the floor, thereby providing sufficient space for the law enforcement and/or military team to enter the shelter via the door that has just been opened by the forcible entry tool 20, 42.

Prior art forcible entry tools are often driven by an external pump that is carried as a back-pack or by a stand-alone pump which is fluidly connected by one or more hoses to the forcible entry tool. The back-pack pump and the stand-alone pump both significantly compromise the maneuverability of the operator due to their substantial size and weight. Maneuverability is even more compromised when heavy, large and complex solenoid valves are added to the pump for remote operation.

According to the invention, it is possible to provide a forcible entry tool 20, 42 that does not require an external pump, is capable of being remotely operable and that is still sufficiently lightweight and compact for the operator to maneuver in tight hallways, alleys and the like.

Figure 9:
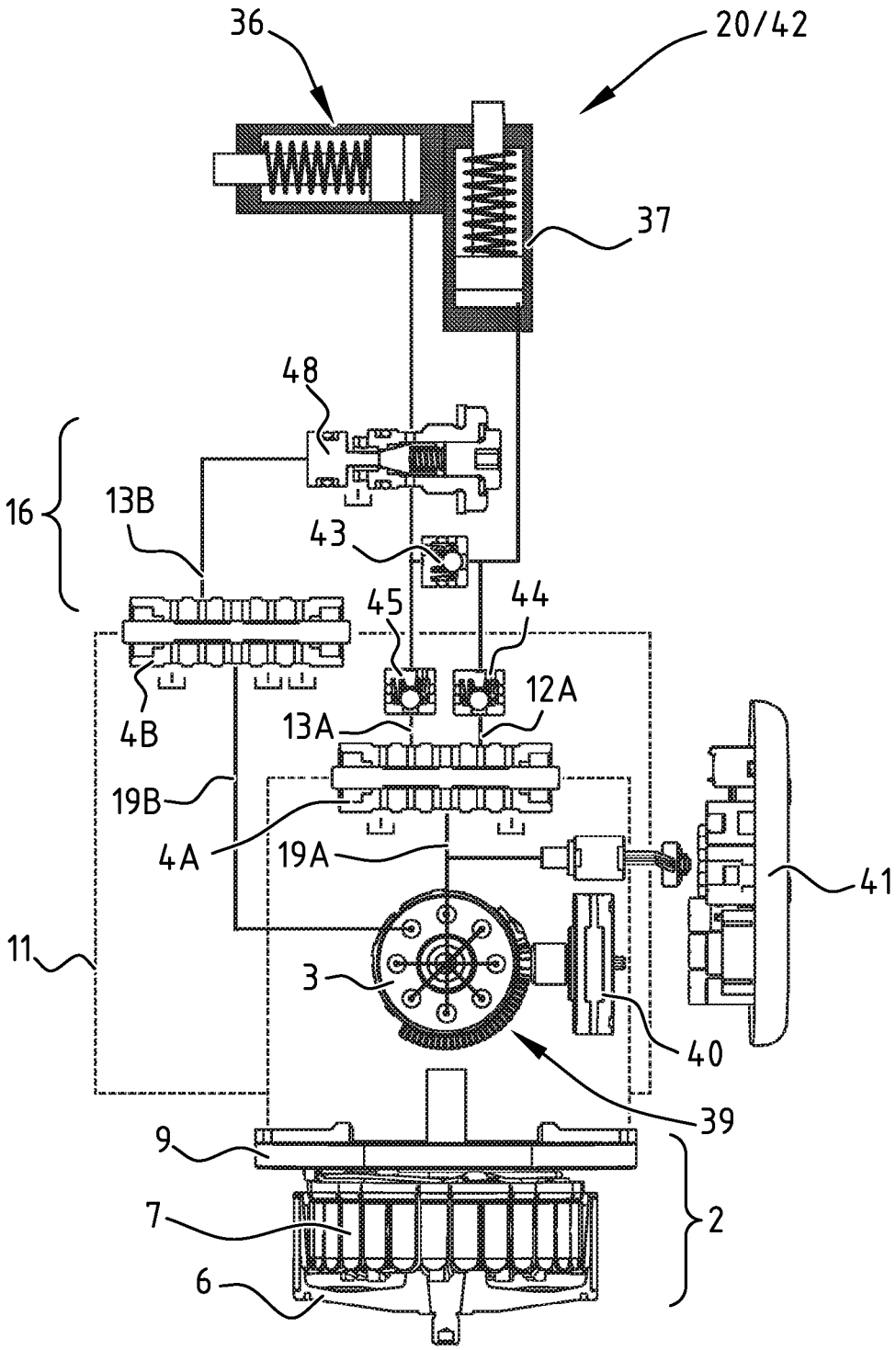
FIG. 9 is a schematic overview of the third embodiment according to the present invention showing the forcible entry tool.

FIG. 9 shows a schematic overview of forcible entry tool 20/42 of the third embodiment. In contrast to the first embodiment, forcible entry tool 20, 42 comprises: a first pressure channel 19A and a separate second pressure channel 19B, both outputted from different sets of the pluralities of pistons 17 from pump 3; a first control valve 4A connected to the first pressure channel 19A and having a first valve opening 12A and a second valve opening 13A; a second control valve 4B connected to the second pressure channel 19B and having a first valve opening 12B; and a pilot valve 48 configured to, when activated, release pressure of both the first cylinder 36 and the second cylinder 37. The first control valve 4A is configured to extend either the first cylinder 36, or the second cylinder 37 in correspondence with the selected one of the plurality of drive modes of the drive 2. The second control valve 4B is configured to activate or deactivate the pilot valve 48 in correspondence with the selected one of the plurality of drive modes of the drive 2.

The forcible entry tool 20, 42 may further comprise a ring shaped element 39 and a motor 40, which are both described in the international patent application WO 2020 043843 A1 of Applicant, which is herein incorporated by reference. The ring shaped element 39 may comprise a plurality of lips configured to block or open one or more of the suction ports of the plurality of pistons 17. The motor 40 is configured to rotate the ring shaped element 39 around pump 3, thereby selectively blocking or opening certain ones of the plurality of pistons 17. The electronic controller 41 is configured to set a selected one of the plurality of drive modes of the drive 2, to drive the motor 40, and to receive a (wireless) signal from a remote controller unit.

Blocking the suction ports of the pistons 17 that are in correspondence with the second pressure channel 19B eliminates the hydraulic flow F in the second pressure channel 19B, thereby eliminating activation or deactivation of the pilot valve 48 regardless of the position of them second control valve 4B. However, if simultaneously, the suction ports of the pistons 17 that are in correspondence with the first pressure channel 19A are opened, the first cylinder 36 or the second cylinder 37 will be driven by the drive 2 depending on the position of the first control valve 4A that is associated with the selected drive mode.

On the contrary, blocking the suction ports of the pistons 17 that are in correspondence with the first pressure channel 19A eliminates the hydraulic flow F in the first pressure channel 19A, thereby eliminating any extending movement of the first cylinder 36 or of the second cylinder 37 regardless of the position of the first control valve 4A. However, if simultaneously, the suction ports of the pistons 17 that are in correspondence with the second pressure channel 19B are opened, the pilot valve 48 will be activated or deactivated by the drive 2 depending on the position of the second control valve 4B that is associated with the selected drive mode.

As both the drive modes of the drive 2 and the drive mode of the motor 40 are set by the electronic controller 41, which is in turn controllable via (wireless) connection by a remote control unit, it is now possible to remotely, individually control both the first cylinder 36 and the second cylinder 37 in an extending direction and remotely release the pressure of both the first cylinder 36 and the second cylinder 37.

Figure 10:
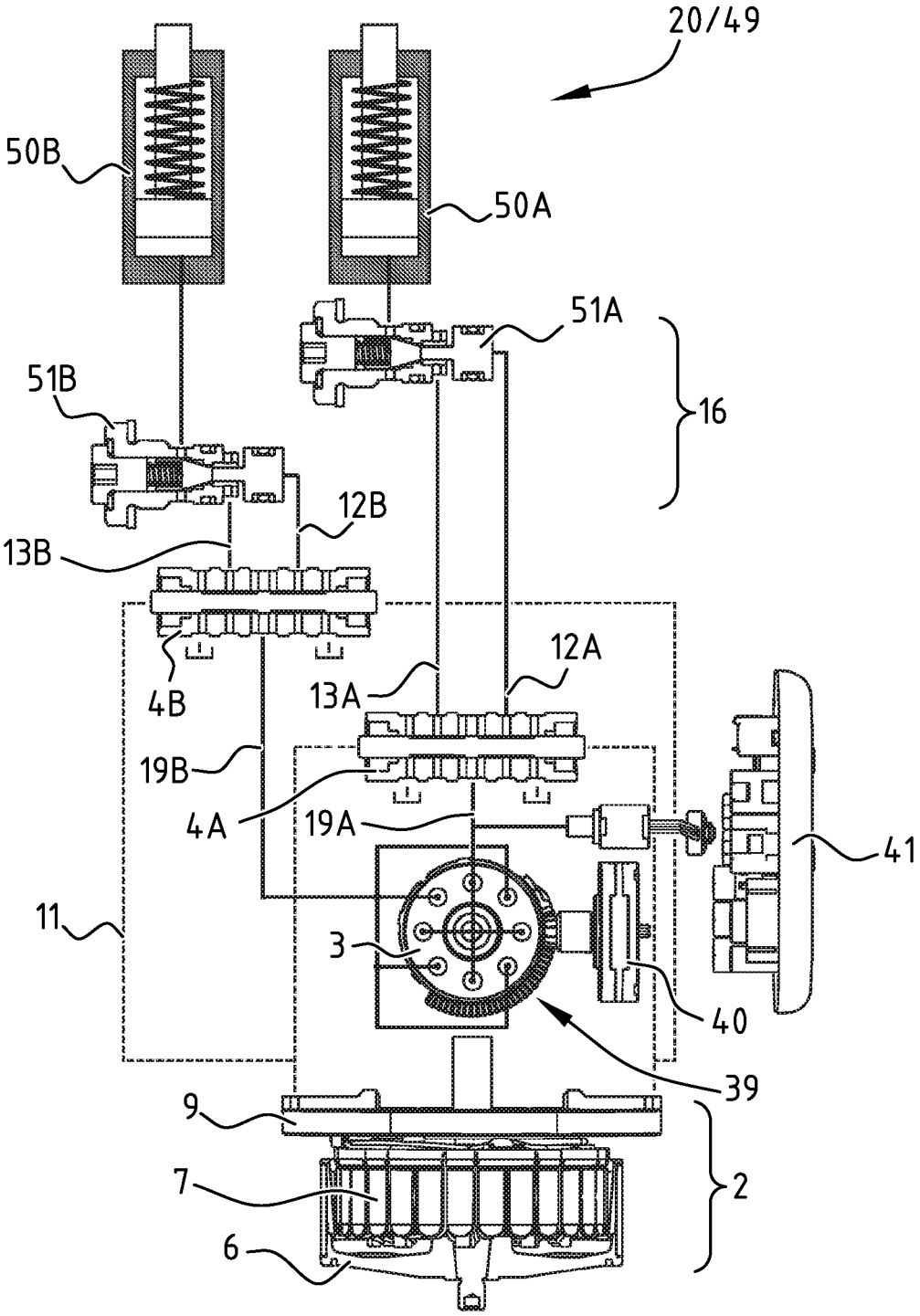
FIG. 10 is a schematic overview of a fourth embodiment according to the present invention showing an emergency lift system.

The fourth embodiment, shown in a schematic overview in FIG. 10, is related to an emergency lift system 20, 49 comprising a first hydraulic strut 50A and a second hydraulic strut 50B. The emergency lift system 20, 49 is often used for temporary lifting an object to extract, for instance, a person or animal entrapped under said object. In such an application, controlled lifting is of high importance as the entrapped person or animal may be in a life threatening situation and where uncontrolled movement of the object to be temporarily lifted may further deteriorate the life threatening situation of the entrapped person or animal. To ensure safe and controlled lifting, the operator should be able to move freely around the object to be temporarily lifted so that the operator may determine if lifting is safe and will not result in uncontrolled movement of the object to be temporarily lifted. Furthermore, speed is often of high importance as the entrapped person or animal may suffer from internal bleedings or may have breathing difficulties. Such a scenario may be the result of, for instance, a road traffic accident or an earthquake, wherein a rescue worker may be forced to carry the emergency lift system 20, 49 over a substantial distance from the rescue vehicle to the object to be temporarily lifted.

Prior art emergency lift systems often comprise multiple hand operated pumps, typically one for each hydraulic strut. Consequently, these hand operated pumps do not allow the operator to move freely around the object to be temporarily lifted whilst simultaneously operating the emergency lift system. Furthermore, remotely controlled pumps in said prior art emergency lift system often comprise solenoid valves to selectively extend or retract either one, or both of the hydraulic struts. However, these solenoid valves may excessively increases the weight and size of these existing remotely controlled pumps which has a negative effect on the maneuverability of the rescue worker, and increasing the time of arrival on the rescue scene due to the negative effects of size and weight on the portability.

According to the invention, it is possible to provide an emergency lift system 20, 49 wherein the drive assembly 1 is remotely controlled and configured to selectively extend or retract either one, or both of the hydraulic struts 50A, 50B while still being sufficiently lightweight and compact so that it is mobile and easily transportable by the operator from the rescue vehicle to the object to be temporarily lifted.

The emergency lift system 20, 49 shown in FIG. 10 comprises: a first pressure channel 19A and a separate second pressure channel 19B, both outputted from different sets of the pluralities of pistons 17 from pump 3; a first control valve 4A connected to pressure channel 19A and having a first valve opening 12A and a second valve opening 13A; a second control valve 4B connected to the second pressure channel 19B and having a first valve opening 12B and a second valve opening 13B, and a first pressure controlled check valve 51A and a second pressure controlled check valve 51B. The first pressure controlled check valve 51A is configured to allow hydraulic fluid, in particular oil, coming from the second valve opening 13A, to flow into first hydraulic strut 50A, to block hydraulic fluid, coming from the first hydraulic strut 50A while the first valve opening 12A of the first control valve 4A is not pressurized, and to allow hydraulic fluid, coming from first hydraulic strut 50A, to flow into the second valve opening 13A of the first control valve 4A whilst the first valve opening 12A thereof is pressurized. The second pressure controlled check valve 51B is configured to allow hydraulic fluid, coming from the second valve opening 13B of the second control valve 4B, to flow into the second hydraulic strut 50B, to block the hydraulic fluid, coming from the second hydraulic strut 50B while the first valve opening 12B of the second control valve 4B is not pressurized, and to allow the hydraulic fluid, coming from the second hydraulic strut 50B, to flow into the second valve opening 13B of the second control valve 4B whilst first valve opening 12B thereof is pressurized. The first control valve 4A is configured to extend or retract the first hydraulic strut 50A in correspondence with the selected one of the plurality of drive modes of the drive 2. The second control valve 4B is configured to extend or retract the second hydraulic strut 50B in correspondence with the selected one of the plurality of drive modes of the drive 2.

The emergency lift system 20, 49 further comprises a ring shaped element 39 and a motor 40, which are both described in the international patent application WO 2020 043843 A1 of Applicant, which is herein incorporated by reference. The ring shaped element 39 comprises a plurality of lips configured to block or open one or more than one of the suction ports of the plurality of pistons 17. The motor 40 is configured to rotate the ring shaped element 39 around pump 3, thereby selectively blocking or opening certain ones of the plurality of pistons 17. Furthermore, the emergency lift system 20, 49 may comprise an electronic controller 41, configured to set a selected one of the plurality of drive modes of the drive 2, to drive the motor 40, and to receive a (wireless) signal from a remote controller unit.

Blocking the suction ports of the pistons 17 that are in correspondence with the second pressure channel 19B eliminates the hydraulic flow F in said second pressure channel 19B, thereby eliminating extension or retraction of the second hydraulic strut 50B regardless of the position of the second control valve 4B. However, if the suction ports of the pistons 17 that are in correspondence with the first pressure channel 19A are simultaneously opened, the first hydraulic strut 50A will be extended or retracted by the drive 2 depending on the position of the control valve 4A that is associated with the selected drive mode. On the contrary; blocking the suction ports of the pistons 17 that are in correspondence with the first pressure channel 19A eliminates the hydraulic flow F in said first pressure channel 19A, thereby eliminating extension or retraction of the first hydraulic strut 50A regardless of the position of the first control valve 4A. However, if simultaneously, the suction ports of the pistons 17 that are in correspondence with pressure channel 19B are opened, second hydraulic strut 50B will be extended or retracted by drive 2 depending on the position of the control valve 4B that is associated with the selected drive mode.

If none of the suction ports of the pistons 17 that are in correspondence with pressure channel 19A or pressure channel 19B are blocked, both the first hydraulic strut 50A and the second hydraulic strut 50B are simultaneously extended or retracted by drive 2 depending on the position of the first control valve 4A and the second control valve 4B that are associated with the selected drive mode.

As both the drive modes of the drive 2 and of the drive of the motor 40 are set by electronic controller 41, which is in turn controllable via a (wireless) connection by a remote control unit, it is now possible to remotely, individually or simultaneously extend or retract the first hydraulic strut 50A and or the second hydraulic strut 50B.

Although they show preferred embodiments of the invention, the above described embodiments are intended only to illustrate the invention and not to limit in any way the scope of the invention. Moreover, the various aspects and features described and shown in the specification can be applied, individually, wherever possible. These individual aspects, and in particular the aspects and features described in the attached dependent claims and embodiments, may be an invention in its own right that is related to a different problem relative to the prior art, and may be made subject of a divisional patent application.

It should be understood that where features mentioned in the appended claims are followed by reference signs, such signs are included solely for the purpose of enhancing the intelligibility of the claims and are in no way limiting on the scope of the claims. Furthermore, it is particularly noted that the skilled person can combine technical measures of the different embodiments. The scope of protection is defined solely by the following claims.

The invention claimed is:

1. A drive assembly, comprising:

a drive, controllable to exhibit a selected one of a plurality of drive modes that comprise driving said drive in one of a first driving direction and a second driving direction, the second driving direction being directed opposite relative to the first driving direction, the drive comprising an electric motor that comprises:

a rotor, and a stator that is configured to be set in one of a plurality of stator positions that are each associated with one of the plurality of drive modes;

a pump that is drivable by the drive and configured to produce a hydraulic flow, the pump being configured to produce the hydraulic flow to flow in a flow direction that is independent of the first driving direction or the second driving direction of the selected drive mode; and a control valve that is configured to be set in a valve position associated with the selected drive mode and configured to thereby direct the hydraulic flow produced by the pump depending on the selected drive mode of the drive along a selected one or more of a plurality of flow paths that are arranged downstream of the pump.

2. The drive assembly according to claim 1, wherein said stator is, relative to a pump housing of said pump, rotatable over a limited angular range between a first stator position and a second stator position.

3. The drive assembly according to claim 2, wherein the first stator position is a first extreme position of the stator when the drive is driven in the first driving direction.

4. The drive assembly according to claim 2, wherein the second stator position is a second extreme position of the stator when the drive is driven in the second driving direction.

5. The drive assembly according to claim 1, wherein the stator is disposed on a carrier that is arranged concentric relative to a drive axis of the drive and rotatable over a predetermined angular range to allow the stator to be set in one of the plurality of stator positions.

6. The drive assembly according to claim 5, further comprising a mechanical link between the stator or the carrier and the control valve.

7. The drive assembly according to claim 5, wherein the carrier comprises a guide slot that is configured to guide the mechanical link when the carrier rotates relative to the pump housing and thereby adjust the valve position of the control valve.

8. The drive assembly according to claim 6, wherein the mechanical link is a lever arm that is pivotable around a pivot.

9. The drive assembly according to claim 1, wherein the plurality of drive modes comprises driving said drive at different driving speeds or different driving torques, the drive assembly further comprising a pretensioner that is configured to pretension the stator and thereby define a threshold force, said pretensioner being configured to:

maintain the stator in the first stator position when the rotor rotates below a predetermined rotation speed or driving torque associated with the threshold force, and allow the stator to rotate to the second stator position when the rotor rotates above the predetermined rotation speed or driving torque associated with the threshold force.

10. The drive assembly according to claim 9, wherein the pretensioner is a spring.

11. The drive assembly according to claim 1, further comprising at least a first valve opening and a second valve opening, wherein the control valve is configured to exhibit:

a first valve position in which the hydraulic flow produced by the pump is configured to flow in a first flow direction, the first valve opening defining an outlet, and a second valve position in which the hydraulic flow produced by the pump is configured to flow in a second flow direction that is directed opposite the first flow direction, the second valve opening defining the outlet.

12. The drive assembly according to claim 11, wherein at least one of:

the second valve opening defines an inlet in the first valve position, and the first valve opening defines the inlet in the second valve position.

13. The drive assembly according to claim 11, further comprising:

a first connector that is in fluid connection with the first valve opening, and a second connector that is in fluid connection with the second valve opening, wherein the first connector and the second connector are each connected or connectable to a hydraulic circuit.

14. The drive assembly according to claim 1, wherein:

said pump comprises a plurality of pistons that each produce hydraulic flow, and the control valve is configured to exhibit a plurality of valve positions configured to selectively control the hydraulic flow.

15. The drive assembly according to claim 14, wherein selective control of the hydraulic flow comprises blocking an inlet of one or more of the plurality of pistons.

16. The drive assembly according to claim 14, wherein selective control of the hydraulic flow comprises diverting the hydraulic flow produced by one or more of the plurality of pistons back to a reservoir and thereby adjusting the flow rate of the hydraulic flow output by the drive assembly.

17. The drive assembly according to claim 1, further comprising one or more additional control valves configured to be set in a valve position associated with the selected drive mode and configured to thereby direct the hydraulic flow along a selected one of a plurality of flow paths depending on the selected drive mode of the drive.

18. A system, comprising:

the drive assembly according to claim 1; and a hydraulic tool comprising the hydraulic circuit, said hydraulic tool being one of a hydraulic strut, a skidding tool, a cutter, a spreader, a hydraulic door opener, a ram, and lifting equipment.

* * * * *